United States Patent [19]

Zwald

[11] Patent Number: 4,733,123

[45] Date of Patent: Mar. 22, 1988

[54] DIFFUSER FOR AN ARC DISCHARGE LAMP

[75] Inventor: John J. Zwald, Marblehead, Mass.

[73] Assignee: GTE Products Corporation, Danvers, Mass.

[21] Appl. No.: 918,435

[22] Filed: Oct. 14, 1986

[51] Int. Cl.[4] ..... H01J 61/38; F21V 11/00

[52] U.S. Cl. ..... 313/116; 362/355; 362/359

[58] Field of Search ..... 313/116; 362/351, 355, 362/356, 359, 457

[56] References Cited

U.S. PATENT DOCUMENTS

| | | | |
|---|---|---|---|
| 3,634,681 | 1/1972 | Johnson et al. | 240/51.12 |
| 4,208,604 | 6/1980 | Courwenberg | 313/113 |
| 4,374,340 | 2/1983 | Bouwknegt et al. | 313/220 |
| 4,383,200 | 5/1983 | Van Zon et al. | 315/57 |
| 4,426,602 | 1/1984 | Mollet et al. | 315/58 |
| 4,481,442 | 11/1984 | Albrecht et al. | 313/493 |

FOREIGN PATENT DOCUMENTS

| | | | |
|---|---|---|---|
| 1355598 | 1/1964 | France | 313/116 |

OTHER PUBLICATIONS

"Twin Tube Fluorescent System", 3/1985, from GTE.

*Primary Examiner*—David K. Moore
*Assistant Examiner*—Sandra L. O'Shea
*Attorney, Agent, or Firm*—Carlo S. Bessone

[57] ABSTRACT

A diffuser for an arc discharge lamp having a sealed envelope of light-transmitting vitreous material including at least two longitudinally extending leg members spaced a predetermined distance thereapart and joined together by a transversely extending envelope portion. The diffuser is formed for disposal adjacent the leg members in a predetermined alignment to provide an appearance of a substantially uniform light output from the entirety of the envelope during operation of the lamp. Preferably, the diffuser includes a longitudinally bifurcated member having two leg sections joined together by an intermediate section and can easily be attached to the arc discharge lamp and subsequently removed therefrom upon failure of the lamp.

20 Claims, 4 Drawing Figures

DIFFUSER FOR AN ARC DISCHARGE LAMP

TECHNICAL FIELD

This invention relates to a diffuser and, more particularly, to a diffuser for an arc discharge lamp having a pair of spaced-apart leg members.

BACKGROUND OF THE INVENTION

Because of the increasing cost of electrical energy, the substitution of initially costlier but more energy efficient lamp types in place of incandescent lamps has become practical. A prime candidate for this substitution is the fluorescent lamp, primarily because of its high luminous efficacy.

Compact fluorescent lamps are known in which the envelope includes at least two longitudinally extending leg members joined together by a transversely extending envelope portion. One example of such a lamp which is commercially available is the "Twin-Tube" fluorescent lamp manufactured by GTE Sylvania, Danvers, Massachusetts. Other examples are disclosed in U.S. Pat. No. 4,374,340, which issued to Bouwknegt et al on Feb. 15, 1983; U.S. Pat. No. 4,426,602, which issued to Mollet et al on Jan. 17, 1984; and U.S. Pat. No. 4,481,442, which issued to Albrecht et al on Nov. 6, 1984.

In lamps of the above type, in which a plurality of spaced-apart leg members are employed, the light output resulting from the lamp is generally non-uniform (i.e., the silhouette of the individual leg members is clearly distinguishable) and may be aesthetically displeasing in particular lighting applications in which the lamp envelope is exposed.

BRIEF SUMMARY OF THE INVENTION

It is, therefore, an object of this invention to obviate the disadvantages of the prior art.

It is another object of the invention to provide a more uniform light output from an arc discharge lamp having at least two longitudinally extending leg members joined together by a transversely extending envelope portion.

It is another object of the invention to provide a diffuser for an arc discharge lamp which can easily be attached to a manufactured lamp.

It is another object of the invention to provide a diffuser for an arc discharge which can easily be removed and reused upon failure of the lamp.

These objects are accomplished, in one aspect of the invention, by the provision of an arc discharge lamp comprising a sealed envelope of light-transmitting vitreous material having a pair of end portions and including at least two longitudinally extending leg members having a predetermined spacing therebetween. The leg members are joined together by a transversely extending envelope portion. An ionizable medium is contained within the envelope and an electrode is located within each of the end portions. A phosphor layer is disposed on the internal surface of the envelope. A diffuser is disposed adjacent the leg members in a predetermined alignment with the predetermined spacing between the leg members of the envelope to provide an appearance of a substantially uniform light output from the entirety of the envelope during operation of the lamp.

In accordance with still further teachings of the present invention, the arc discharge lamp is a fluorescent lamp. Preferably, the lamp envelope has adjacently located end portions which are connected to a lamp base. A starter is preferably located within the lamp base.

In accordance with further aspects of the present invention, the diffuser includes a longitudinally bifurcated member having two leg sections joined together by an intermediate section. Preferably, the diffuser contains two oppositely disposed surfaces located respectively on the leg sections for contacting the external surface of the leg members of the lamp. In a preferred embodiment, the oppositely disposed surfaces of the longitudinally bifurcated member are substantially wedge-shaped. Preferably, the longitudinally bifurcated member is made of a translucent, resilient plastic material.

In accordance with further teachings of the present invention, the intermediate section of the diffuser defines an opening to receive the transversely extending envelope portion of the envelope. Preferably, the diameter of the opening of the intermediate section is equal to about the diameter of the transversely extending envelope portion of the envelope.

BEST MODE FOR CARRYING OUT THE INVENTION

For a better understanding of the present invention, together with other and further objects, advantages and capabilities thereof, reference is made to the following disclosure and appended claims taken in conjunction with the above-described drawings.

Figure 1:
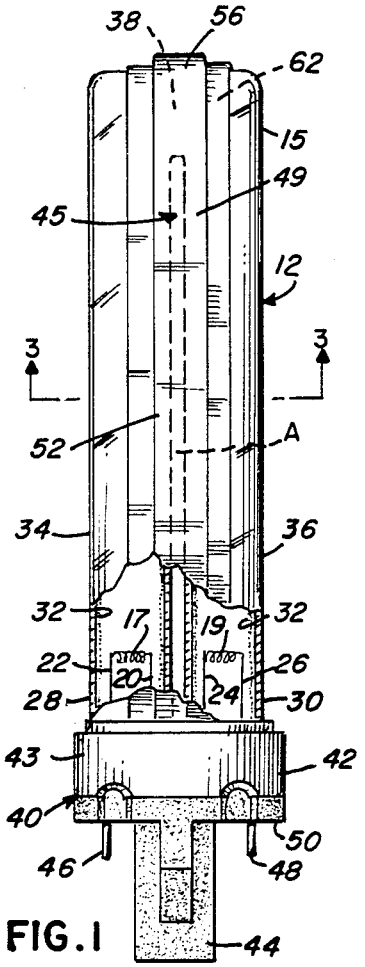
FIG. 1 is a front elevational, partially sectional view of an embodiment of an arc discharge lamp with diffuser according to the invention.
Figure 2:
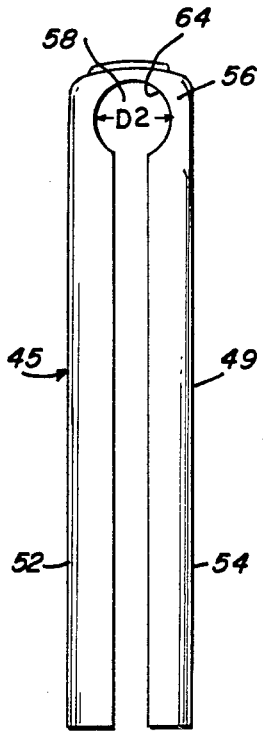
FIG. 2 is a side elevational view of an embodiment of a diffuser for an arc discharge lamp according to the invention.

Referring now to the drawings with greater particularity, there is shown in FIG. 1 an arc discharge lamp 12 for use with the diffuser 45 of the present invention. The arc discharge lamp 12 illustrated in the drawings and selected as preferred (but not limited thereto) for use in connection with the present invention is a "Twin-Tube" fluorescent lamp manufactured by GTE Sylvania, Danvers, Mass. Such lamps are manufactured in different varieties (e.g., 5, 7, 9 and 13 watt varieties) and incorporate many of the components necessary for operation of a fluorescent lamp, such as the starter and radio frequency suppressing capacitor.

With reference to FIG. 1, it will be noted that such "Twin-Tube" type fluorescent lamps generally include a sealed envelope 15 of light-transmitting vitreous material, such as soda-lime or lead glass and having a pair of end portions 28, 30 and containing an ionizable medium including a quantity of mercury and an inert starting gas at low pressure, for example, in the order of 1–5 mm of mercury. The starting gas can be, for example, argon, krypton, neon, or helium, or a mixture of these and other gases. An electrode 17, 19 supported by lead-in wires 20, 22 and 24, 26, respectively, is located within a respective end portion 28, 30 of envelope 15. Electrodes 17, 19 can be, for example, a double or triple-coiled tungsten filament of the usual type and carry a coating thereon which is usually in the form of carbonates which, upon processing, are converted to oxides. A phosphor layer 32, which converts the ultaviolet radiation generated in the mercury discharge into visible radiation, is disposed on the internal surface of envelope 15. Preferably, envelope 15 has at least first and second parallel, longitudinally extending leg members 34, 36 joined together by a transversely extending envelope portion 38. Alternatively, the transversely extending envelope portion may be of the forms as shown in U.S. Pat. Nos. 4,374,340 and 4,481,442. Leg members 34 and 36 are spaced a predetermined distance D1 apart (FIG. 3), such as about 2.0 millimeters. Alternatively, envelope 15 of lamp 12 may comprise a plurality of leg portions (such as four) disposed in a substantially quadrangular or quadralinear (i.e., in the same plane) columnar array and joined together by a plurality of transversely extending envelope portions to form a single elongated discharge path. Each of the leg portions is spaced a predetermined distance apart from an adjacent leg portion. The distances between adjacent leg portions may be equal or may vary. As best shown in FIG. 1, lamp end portions 28, 30 may be adjacently located and connected to a suitable lamp base 40 including a generally oval shaped upper portion 42 having an external surface 43 and a lower portion 44. A conventional starter (not shown) including a conventional glow bottle and radio frequency suppression capacitor is located within lower portion 44 and is electrically connected to lead-in wires 20 and 24. A pair of contacts 46, 48 project from a surface 50 of lamp base 40 and are electrically connected to lead-in wires 22, 26, respectively.

Figure 3:
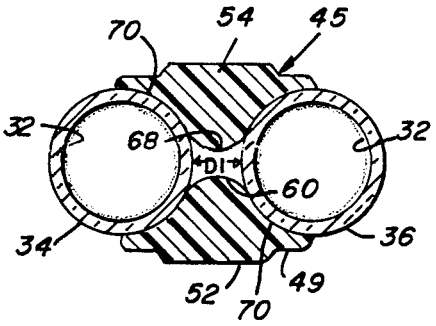
FIG. 3 is an enlarged cross-sectional view of the arc discharge lamp with diffuser taken along the line 3—3 in FIG. 1.
Figure 4:
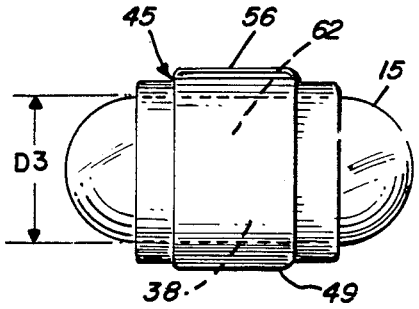
FIG. 4 is an enlarged plan view of the arc discharge lamp with diffuser in FIG. 1.

In accordance with the teachings of the present invention, lamp 12 as shown in FIGS. 1–4 is provided with a diffuser 45 comprising means having light-scattering properties disposed adjacent leg members 34, 36 of envelope 15 in a predetermined alignment with predetermined spacing D1 between the two leg members to provide an appearance of a substantially uniform light output from the entirety of the envelope during operation of the lamp. The substantially uniform light output is such that the actual outline or shape of the envelope is obscured by the diffuser. Diffuser 45 covers an area A (FIG. 1) defined between lamp leg members 34, 36 to diffuse the light from the lamp leg members by "filling in" area A with light and thereby avoiding the appearance of separate leg members. Preferably, diffuser 45 is in the form of a laterally bifurcated member 49 having two leg sections 52, 54 joined together by a generally U-shaped intermediate section 56. As best shown in FIG. 3, diffuser 45 has two oppositely disposed substantially wedge-shaped surfaces 60, 68 on leg sections 52, 54, respectively, for contacting the external surface 70 of lamp leg members 34, 36. The U-shaped intermediate section 56 of diffusing means 45 defines a circular opening 58 to receive transversely extending portion 38 of envelope 15. Preferably, the internal surface 64 of intermediate section 56 contacts a portion of the external surface 62 of transversely extending envelope portion 38 of envelope 15. Circular opening 58 has a diameter D2 (FIG. 2) equal to about the outside diameter D3 (FIG. 4) of transversely extending envelope portion 38. Circular opening 58, which conforms to the transversely extending envelope portion 38, aids in retaining bifurcated member 49 in place by preventing undesired longitudinal movement. Lateral movement of bifurcated member 49 is prevented by the substantially wedge-shaped surfaces 60, 68 on leg section 52, 54, respectively. Member 49 can be made of, for example, any translucent, resilient plastic material suitable of being easily snapped over a manufactured lamp and which will diffuse light so that the individual lamp leg members cannot be clearly distinguishable during operation of the lamp. To remove the diffuser upon failure of lamp 12, leg sections 52 and 54 are spread apart slightly while moving bifurcated member 49 in a longitudinal direction.

While there have been shown and described what are at present considered to be the preferred embodiments of the invention, it will be apparent to those skilled in the art that various changes and modifications can be made herein without departing from the scope of the invention as defined by the appended claims. For example, if a lamp is being employed wherein the envelope has more than two longitudinally extending leg members, the diffuser may have more than two leg sections. The embodiment shown in the drawings and described in the specification is intended to best explain the principles of the invention and its practical application to hereby enable others in the art to best utilize the invention in various embodiments and with various modifications as are suited to the particular use contemplated.

What is claimed is:

1. A diffuser for an arc discharge lamp, said lamp having a sealed envelope of light-transmitting vitreous material and having a pair of end portions and including at least two longitudinally extending leg members having a predetermined spacing therebetween and a transversely extending envelope portion joining said longitudinally extending leg members, said diffuser comprising means having light-scattering properties and formed for disposal adjacent said leg members in a predetermined alignment with said predetermined spacing between said leg members to provide an appearance of a substantially uniform light output from the entirety of said envelope during operation of said lamp.

2. The diffuser of claim 1 wherein said diffuser includes a longitudinally bifurcated member having two leg sections joined together by an intermediate section.

3. The diffuser of claim 2 wherein said diffuser contains two oppositely disposed surfaces located respectively on said leg sections formed to contact the external surface of said leg members of said envelope.

4. The diffuser of claim 3 wherein said oppositely disposed surfaces are substantially wedge-shaped.

5. The diffuser of claim 2 wherein said intermediate section of said diffuser defines an opening to receive said transversely extending envelope portion of said envelope.

6. The diffuser of claim 5 wherein the diameter of said opening of said intermediate section is equal to about the diameter of said transversely extending envelope portion of said envelope.

7. The diffuser of claim 2 wherein said bifurcated member is resilient plastic.

8. The diffuser of claim 2 wherein said bifurcated member is translucent.

9. An arc discharge lamp comprising:

a sealed envelope of light-transmitting vitreous material having a pair of end portions and including at least two longitudinally extending leg members having a predetermined spacing therebetween, said leg members being joined together by a transversely extending envelope portion, an ionizable medium contained within said envelope, an electrode located within each of said end portions, and a phosphor layer disposed on the internal surface of said envelope; and a diffuser disposed adjacent said leg members in a predetermined alignment with said predetermined spacing between said leg members to provide an appearance of a substantially uniform light output from the entirety of said envelope during operation of said lamp.

10. The arc discharge lamp of claim 9 wherein said arc discharge lamp is a fluorescent lamp.

11. The arc discharge lamp of claim 10 wherein said end portions are adjacently located.

12. The arc discharge lamp of claim 11 wherein said fluorescent lamp further includes a lamp base connecting to said end portions.

13. The arc discharge lamp of claim 12 wherein a starter is included within said lamp base.

14. The arc discharge lamp of claim 9 wherein said diffuser includes a longitudinally bifurcated member having two leg sections joined together by an intermediate section.

15. The arc discharge lamp of claim 14 wherein said diffuser contains two oppositely disposed surfaces located respectively on said leg sections for contacting the external surface of said leg members of said lamp.

16. The arc discharge lamp of claim 15 wherein said oppositely disposed surfaces are substantially wedge-shaped.

17. The arc discharge lamp of claim 14 wherein said intermediate section of said diffuser defines an opening to receive said transversely extending envelope portion of said envelope.

18. The arc discharge lamp fo claim 17 wherein said diameter of said opening of said intermediate section is equal to about the diameter of said transversely extending envelope portion of said envelope.

19. The arc discharge lamp of claim 14 wherein said longitudinally bifurcated member is resilient plastic.

20. The arc discharge lamp of claim 14 wherein said longitudinally bifurcated member is translucent.

* * * * *